US005407208A

United States Patent [19]

Keller et al.

[11] Patent Number: 5,407,208

[45] Date of Patent: Apr. 18, 1995

[54] CARD GAME KIT

[76] Inventors: Kris Keller; Kevin Keller, both of 6613 Kings Crown, San Antonio, Tex. 78233

[21] Appl. No.: 279,543

[22] Filed: Jul. 25, 1994

[51] Int. Cl.[6] ..... A63F 1/00

[52] U.S. Cl. ..... 273/274; 273/292

[58] Field of Search ..... 273/292, 303, 305, 306, 273/274, 309

[56] References Cited

U.S. PATENT DOCUMENTS

| | | | |
|---|---|---|---|
| D. 263,975 | 4/1982 | Quiroga et al. | 273/274 X |
| 3,796,433 | 3/1974 | Fraley et al. | 273/292 X |
| 4,055,347 | 10/1977 | Kreischer . | |
| 4,222,572 | 9/1980 | Baker | 273/274 X |
| 5,141,234 | 8/1992 | Boylan et al. | 273/292 X |
| 5,257,789 | 11/1993 | Le Vasseur | 273/274 X |
| 5,275,415 | 1/1994 | Wisted | 273/292 X |
| 5,275,416 | 1/1994 | Schorr et al. | 273/274 X |
| 5,280,915 | 1/1994 | Groussman | 273/292 |
| 5,288,081 | 2/1994 | Breeding | 273/292 |
| 5,320,356 | 6/1994 | Cauda | 273/292 |

FOREIGN PATENT DOCUMENTS

| | | | |
|---|---|---|---|
| 2040694 | 9/1980 | United Kingdom | 273/292 |

*Primary Examiner*—William E. Stoll

*Attorney, Agent, or Firm*—Gunn, Lee & Miller

[57] ABSTRACT

A kit for playing a card game having a playing board with a playing surface. The board provides a multiplicity of players' stations each including two betting positions. A dealer's draw station is also provided. The kit further includes a fifty-two card deck. The deck is made up of twenty-five 10 value cards, twenty-five 5 value cards, and two Aces. A dealer's draw value generator such as a tossable die or cube is provided which has three different numerical values represented on opposite sides of the cube. By making various bets or wagers, and being dealt playing cards, the players compete against the dealer. The winner is the one who is able to total the highest numerical value not exceeding twenty-one.

10 Claims, 1 Drawing Sheet

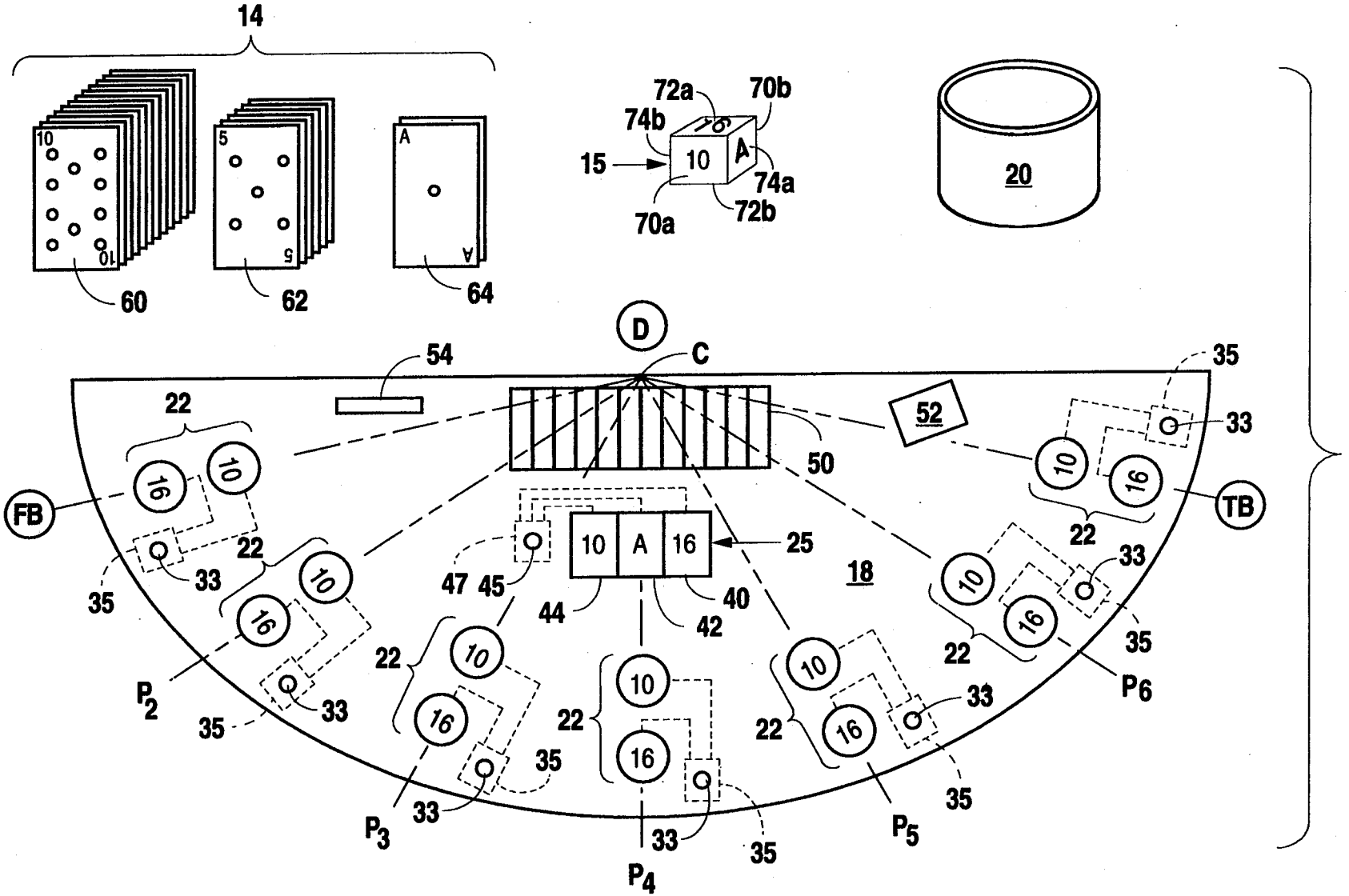
20
52
18
50
25
40
42
44
45
47
54
C
D
TB
FB
P2
P3
P4
P5
P6
22
33
35
14
60
62
64
15
70a
70b
72a
72b
74a
74b

CARD GAME KIT

BACKGROUND OF THE INVENTION

The present invention relates to a kit for playing a card game, more particularly for playing a shortened form of the well-known game called "Blackjack." The shortened version played with the present inventive kit is called Texas Quick Draw.

The origin of Blackjack or Twenty-One is unknown, but a similar game was played in France dating back at least to the seventeenth century. In America, Blackjack has evolved into the most popular game played in casinos. This has not always been the case. The current ability For computers to generate millions of playing hand permutations has allowed Blackjack players to learn various systems to beat the odds in the game. Whether any system has been successful is much debated; however, overall interest and understanding of the game has increased.

The present inventive kit enables the traditional Twenty-One game to be played more quickly because the number of face value cards is reduced to only four values: 10, 5 and Ace (one or eleven). Further, the player's first card is immediately established as either having a numerical value of 16 or 10. Other elements of the kit further increase the speed of play of the game.

SUMMARY OF THE INVENTION

The present kit for playing a card game is made up of a specially arranged playing board with a playing surface having a combination of player stations and a dealer's station. Each of the players' stations include two initial betting positions having a numerical value of either ten or sixteen. The dealer's station includes three separate draw positions.

The kit also includes a deck of fifty-two cards made up of twenty-five cards having a numerical value of10 and twenty-five cards having a numerical value of 5. The two remaining cards arc Aces which may be valued at one or eleven depending upon the dealer's or player's selection.

A dealer's draw numeral generator such as a single die is included in the kit. The die has three sets of opposite sides. One set of opposite sides bears the numerical value of 10, a second set bears the numerical value of 16, and the third set of opposite sides bear the capital letter A representing the word "Ace." The Ace may be valued at either one or eleven at the option of the dealer.

BRIEF DESCRIPTION OF THE DRAWINGS

Fig. 1 illustrates the kit of the present invention including a playing board, a representation of a deck of cards, and a representation of a playing die. Also shown is an optional tossing cup.

DETAILED DESCRIPTION OF THE PREFERRED EMBODIMENT

The present invention is a kit for playing a shortened form of the card game Blackjack or Twenty-One. The kit I I includes a playing board 12, a deck of playing cards 14, and a means for generating a dealer's draw having a value of ten, sixteen, or an Ace, the Ace having a selective value of one or eleven as discussed below. One embodiment of the present kit utilizes a unique die 15. Another embodiment employs either an electronic mechanical, or electro-mechanical numeral generator 47 (shown in dotted lines) activated by a push button 45. The hardware associated with the operation of the particular numeral generator 47 may be housed beneath the board 12 or, with integrated circuitry, inside the thickness of the board 12. Further, the kit may optionally include a cup 20 for tossing the die 15.

The playing board 12 has a top surface 18 which has a multiplicity of player stations 22, preferably seven; however any number of player stations 22 may be provided. In addition to the players' stations 22, a dealer's station 24 is positioned on the board 12 in a location spaced apart from and generally opposite the players' stations 22. As may be seen in FIG. 1, the board 10 may be hemispherical in shape with the players' stations 22 positioned around the outer perimeter of the curved portion of the board 12 while the dealer's station 24 is positioned centrally along the straight section or base section of the board 12.

The board 12 may be placed upon a playing table or other supporting structure (now shown) for the convenience and comfort of the players and dealer. Further, the board 12 may be placed over an existing Blackjack table surface to provide for an alternative game option. Normally, the dealer will stand or sit opposite the players during the playing of the game.

Each player's station 22 includes two betting positions in the preferable form of small circles 30 and 32 with either the numeral 10 or 16 appearing inside the circle. Other geometrical shapes may be used. In FIG. 1 it will be seen that the numeral 10 is placed inside the inner circle 30 while the numeral 16 is placed inside the outer circle 32. The circles may be of any size to provide convenient and easy viewing or observation of the circle and numeral. The preferable size is in the range of 3"–6" diameter with a 4½" diameter being most preferable. The circles 30 and 32 of each station 22 lie on an imaginary straight line or axis (shown in dotted lines $L_l$) radiating outwardly from the center C of the hemispherically shaped board 12. The player station 22 to the dealer's leftmost, FB, is referred to as "first base" and the player station to the dealer's rightmost, TB, is referred to as "third base."

Board 12 has a single dealer's station 24 with three separate draw positions (40, 42 and 44) and may include a check rack 50, a dealing box (or shoe) 52, and a currency slot 54. The shoe 52 is normally to the dealer's D left and the currency slot 54, for the money drop box, is generally to the dealer's right.

The dealer's separate draw positions are shown in FIG. 1 as an elongated rectangle 25 divided into the three smaller square sections or compartments. Draw position 40 is provided with a reference numeral 16 inside the smaller square section, draw position 42, is provided with the capital letter A (representing the word "Ace") inside the smaller square, and draw position 44 is provided with the reference numeral 10 inside the smaller square. Each smaller square (40, 42 and 44) are in range of 3"–5" square; the preferable size is 4"×4".

The playing card deck 14 for the present inventive kit 10 includes fifty-two separate cards. Twenty-five cards 60 carry a face value of ten and bear the numeral 10 printed thereon. Further, these ten value indicia cards 60 may be provided with a graphic or pictorial representation of the value of ten. FIG. 1 shows two groups of five small circles thus totalling ten small circles on the face of each card 60 to provide the pictorial representation of the value of ten. Another twenty-five cards 62 carry a face value of five and bear the numeral 16 printed thereon. These five value indicia cards 62 may also be provided graphic or pictorial illustrations representing the value of five, as shown in FIG. 1.

The remaining two cards in the deck 14 are what are called alternative value indicia cards 64. These cards bear the capital letter A which represents the word "Ace" and carry a value of either one or eleven, the value being selective at the player's or dealer's option depending on which selected value gives the player or dealer the greatest playing advantage. This selection will be discussed further below.

A means for generating the dealer's draw may be a die 15 or a numeral generator 47. Numeral generators are well known and may be mechanical or electromechanical, such as those used in conventional slot machines, or may be fully electronic, such as those utilizing an electronic counter or clock in an integrated circuit. Whichever numeral generator is employed, it may be activated by a push button 45 positioned near the dealer's draw position 25. By pushing button 45, the numeral generator 47 is activated and will provide a visual indication in one of the square sections 40, 42 or 44 at the dealer's draw position. Thus activating the numeral generator 47 will result in the dealer's draw being ten, sixteen, or a capital A (representing the word "Ace"). The visual indication may be such that the generated numeral is illuminated or the numeral appearing in the small square 40, 42 or 44 rotates or tumbles as is known in the conventional mechanical/electronic slot machine.

Another means for generating a dealer's draw is a unique die 15. The die 15 is a standard size cube-shaped die provided with a unique combination of indicia thereon. Two sides 70*a* and 70*b* bear the numeral 10 and carry a value of ten in the game. These sides 70*a* and 70*b* are on opposite sides of the die. Two other opposite sides 72*a* and 72*b* bear the numeral 16 and carry a value of sixteen in the game. Finally, the final two, opposite sides 74*a* and 74*b* of the die 15 bear the capital letter A, again representing the word "Ace," and carry an alternative value of either one or eleven, the value being selective at the player's or dealer's option. Again, as with the alternative value indicia playing cards 64, the alternative value indicia on the die is selected as either a one or eleven depending on which chosen or selected value gives the player or the dealer the greatest playing advantage.

The object of the game played with the present inventive kit is to total the highest numerical value not exceeding twenty-one. Whoever has the higher total, player or dealer, wins the hand. A hand which exceeds twenty-one is called a "bust," and whoever busts looses the hand, except that when player and dealer both bust, the dealer wins. If the player and dealer both achieve equal totals of twenty-one or less, the hand is called a "push," and no money changes hands, except that a two-card holding (by a player) or die toss and single card holding (by the dealer) totalling twenty-one—which can only exist on an Ace and one 10—is called a "natural blackjack" or simply "blackjack" and beats any other hand except another blackjack, which it tics (or pushes.). As has been previously discussed, the capital A or Ace on the cards 64 or the die (the dealer's draw generator) 15 may be regarded as being worth one or eleven (and may so be regarded by the dealer in counting his/her own hand as well as the player in counting his/hers) depending entirely on where the advantage lies. As will be discussed below, the dealer D may be mechanical, since players do not win or lose as a result of any special knowledge or skill of the dealer. The dealer merely pays or collects based upon the outcome of the turn of the cards and the toss of the die.

The game begins with the deck 14 being removed from the shoe 52 (if a shoe is used). The cards are shuffled and the deck is offered to a player for cutting. The player cuts the deck, setting the cut-off portion on the playing surface 12. The dealer completes the cut and thus may take the top card of the deck and place it face up on the bottom of the deck or places it to his right as a "burn." In some game options this first burn may be eliminated.

Each player places a bet at the player station 22 on either of the first betting position 30 having a value of sixteen or the second betting position 32 having a value of 10. This selection represents the player's first card or first numerical value. It is envisioned that in some modifications to the present kit, a player's numeral generator 35 may be employed to "randomly" select the player's first card or first numerical value. Such a generator would be activated by a simple push button 33 located near the dealer's or player's position. Again, the operation and function of such a generator 35 are well known and could easily be incorporated into or beneath the board 12.

After all players have placed their bets, the dealer, or a selected player, activates the numeral generator 47 by pushing button 45 or takes the cup 20 with the die 15 in it, if the cup is optionally used, shakes the die and rolls it onto the playing surface. The side which shows face up on the die belongs to the dealer and becomes his/her first numerical value. The die is placed in the corresponding dealer's draw position on board 12. Thus, if the die shows a 10 face up, the dealer's first "card" or first value is ten. If an A side shows Face up the value may be one or eleven depending on what value the dealer selects to give it. The same is true if the generator 47 results in a ten, sixteen, or capital A being visually indicated in the dealer's draw position. The dealer does not have to announce the value selected on the Ace until his/her hand is complete.

After the dealer's first "card" or numerical value has been determined by the generator or the roll of the die, the dealer may "burn" or set aside from the top of the deck the same number of cards as there are players playing the game. (In some variations of the game this second burning may be eliminated.) All players are then dealt one card, beginning clockwise with the player leftmost of the dealer. This is the first player. The card is dealt face up. The next player, if any, is then dealt a card. This continues for each player at the game.

The numerical value of the card dealt the player is then added to the numerical value he/she placed his/her bet on. At this point the dealer refers back to the first player and offers each player in turn, who has not already "busted" (exceeded twenty-one), an opportunity to possibly better his/her total by being dealt additional cards. The numerical value of the additional cards is added to the already existing total held by that particular player.

After all of the players at the game have either completed their hand, or "busted," the dealer then deals himself/herself a card or cards, until a total of seventeen, twenty, or twenty-one is attained, or, until the dealer "busts." The dealer does not take any cards until each player has either made a hand or held, or exceeded twenty-one and "busted." (Depending upon the game variation, a single player may be dealt his/her entire hand, before proceeding to the next player, and finally to the dealer.)

If the dealer "busts" all players remaining at the game with legitimate hands win. After all hands have been made, whoever is closest to twenty-one without going over, between the dealer and each player, wins. Again, ties are considered a push and no money is exchanged.

It should be understood that generators 35 and 47 may be adjusted to vary the probability of any of the numerals being generated. Such adjustment may be achieved by the casino in the same way that other gambling devices, such as slot machines, are varied.

Variations in the betting and play of Texas Quick Draw may be made as is appropriate to those familiar with the traditional game of Blackjack or Twenty-One. When Texas Quick Draw is played in commercial casinos each house may modify the rules to most specific commercial needs. However, the present inventive kit includes a unique combination of elements which facilitate increasing the speed of play of the game.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

We claim:

1. A kit for playing a card game comprising:

a playing surface, said surface having a multiplicity of player stations, each of said player stations having a first betting position having a value of ten, and a second betting position having a value of sixteen, said surface further having a dealer's station, said dealer's station having a first dealer's draw position having a value of ten, a second dealer's draw position having an alternative value, said alternative value being selective at a dealer's option of one or eleven, and a third dealer's draw position having a value of sixteen;

a deck of playing cards having twenty-five of said cards bearing a ten value indicia, twenty-five of said cards bearing a five value indicia, and two of said cards bearing an alternative value indicia, said alternative value indicia being selective at said player's or said dealer's option of either one or eleven; and a means for generating a dealer's draw value of ten, sixteen, or an alternative value, said alternative value being selective at said dealer's option of either one or eleven.

2. The kit of claim 1 wherein said meads for generating said dealer's draw value further comprises an electronic counter.

3. The kit of claim 2 wherein each of said player stations further comprises a means for randomly selecting and indicating whether said first or said second betting position has been selected.

4. The kit of claim 1 wherein said means for generating said dealer's draw value further comprises a means within said dealer's station for indicating said dealer's draw value.

5. The kit of claim 4 wherein each of said player stations further comprises a means for randomly selecting and indicating whether said first or said second betting position has been selected.

6. The kit of claim 1 wherein said means for generating said dealer's draw value is a die having six sides with two, first opposite sides bearing said ten value indicia; two, second opposite sides bearing said sixteen value indicia; and two, third opposite sides bearing value indicia alternatively valued at said dealer's option of one or eleven.

7. The kit of claim 6 wherein each of said player stations further comprises a means for randomly selecting and indicating whether said first or said second betting position has been selected.

8. The kit of claim 1 wherein each of said player stations further comprises a means for randomly selecting and indicating whether said first or said second betting position has been selected.

9. The kit of claim 8 wherein said means for selecting said betting position is adjustable to vary the probability of selection of either said first or said second betting position.

10. The kit of claim 1 wherein said means for generating said dealer's draw value is adjustable to vary the probability of generation of each of said draw values.

* * * * *